US007299173B2

(12) United States Patent
Ma et al.

(10) Patent No.: US 7,299,173 B2
(45) Date of Patent: Nov. 20, 2007

(54) METHOD AND APPARATUS FOR SPEECH DETECTION USING TIME-FREQUENCY VARIANCE

(75) Inventors: Changxue Ma, Barrington, IL (US); Mark Randolph, Kildeer, IL (US)

(73) Assignee: Motorola Inc., Schaumburg, IL (US)

( * ) Notice: Subject to any disclaimer, the term of this patent is extended or adjusted under 35 U.S.C. 154(b) by 1024 days.

(21) Appl. No.: 10/060,511

(22) Filed: Jan. 30, 2002

(65) Prior Publication Data

US 2003/0144840 A1 Jul. 31, 2003

(51) Int. Cl.
*G10L 21/02* (2006.01)

(52) U.S. Cl. ..... 704/215; 704/233

(58) Field of Classification Search ..... 704/215, 704/233

See application file for complete search history.

(56) References Cited

U.S. PATENT DOCUMENTS

| | | | | |
|---|---|---|---|---|
| 4,222,115 | A * | 9/1980 | Cooper et al. | 375/130 |
| 4,461,024 | A | 7/1984 | Rengger et al. | |
| 4,827,519 | A * | 5/1989 | Fujimoto et al. | 704/250 |
| 5,097,510 | A * | 3/1992 | Graupe | 704/233 |
| 5,617,508 | A | 4/1997 | Reaves | |
| 5,659,622 | A | 8/1997 | Ashley | |
| 5,692,104 | A | 11/1997 | Chow et al. | |
| 5,732,392 | A * | 3/1998 | Mizuno et al. | 704/233 |
| 5,826,230 | A * | 10/1998 | Reaves | 704/233 |
| 5,963,901 | A * | 10/1999 | Vahatalo et al. | 704/233 |
| 5,991,718 | A | 11/1999 | Malah | |
| 6,278,972 | B1 * | 8/2001 | Bi et al. | 704/248 |
| 6,397,050 | B1 * | 5/2002 | Peterson et al. | 455/221 |
| 6,591,234 | B1 * | 7/2003 | Chandran et al. | 704/225 |
| 6,711,536 | B2 * | 3/2004 | Rees | 704/210 |

FOREIGN PATENT DOCUMENTS

| | | |
|---|---|---|
| EP | 0 945 854 A2 | 9/1999 |
| WO | JP94/01181 | 2/1996 |
| WO | WO 01/11606 A1 | 2/2001 |

OTHER PUBLICATIONS

John G. Proakis; "1.1.3 Statistical Averages of Random Variables"; *Digital Communications, Second Edition*; 1989; McGraw-Hill, Inc., pp. 17.

* cited by examiner

*Primary Examiner*—Daniel Abebe
(74) *Attorney, Agent, or Firm*—Sylvia Y. Chen

(57) ABSTRACT

Speech presence is detected by first bandpass filtering (141, 143, 145) the speech to split it into banks of sub-bands. A matrix of shift registers (150) store each sub-band of speech. A power determining circuit (259) then determines individual power measurements of the speech stored in each shift register element. A variance combining circuit (160) combines the individual power measurements to provide a variance for the individual shift registers. A comparator circuit (170) finally compares the variance with at least one threshold to indicate whether speech is detected.

10 Claims, 2 Drawing Sheets

METHOD AND APPARATUS FOR SPEECH DETECTION USING TIME-FREQUENCY VARIANCE

BACKGROUND OF THE INVENTION

1. Technical Field

The present invention relates to speech detection and, more particularly, relates to improved approaches to efficiently detect speech presence in a noisy environment by way of frequency and temporal considerations.

2. Description of the Related Art

In some applications, automatic speech recognition needs to be activated by uttering a particular word sequence such as keywords. For example, if a desktop personal computer has a speech recognizer for dictation or command control, it is desirable to activate the recognizer in the middle of the conversations in his or her office by uttering a keyword. This process of recognizing the keyword from continuous speech waveform is called keyword scanning. This would require the recognizer constantly recognizing the incoming speech and spotting those keywords. Nevertheless, the recognizer cannot be used to constantly monitor the incoming speech because it takes huge computational resources. Some other techniques that demand much less computations and memories have to be utilized to reduce the burden of speech recognizer. It is known that speech detection techniques are ways of eliminating silence segments from speech utterances so that speech recognizer can be speed up and do not wasting a lot of time on those silences or even misrecognize silence as speech. Speech detection techniques are often based on the speech waveform and utilize features such as short-time energy, zero crossing and etc. The same can be used to hypothesize keyword if some other features such as pitch, duration and voicing can be used in junction with word end-pointing techniques. Although the keyword hypothesis will be over generated, it still can reduce a large proportion of computations since the recognizer will only process these hypotheses.

Most speech recognition applications today face the challenging task of segmenting speech based on voice, unvoice & silence detection. A conventional approach is detecting short-term energy and zero crossings of a speech signal. These approaches are not reliable for noisy telephone speech signals due, in part, to the greater noise in a background environment of most telephone conversations. For example, stationary noise such as motor or wind noise and non-stationary noise such as door openings, closing or respiratory exhalation are present in telephone speech.

Accurate speech presence detection also conserves power and processing time for portable electronic devices such as cellular telephones. When reliable speech detection approaches are used, a speech recognition algorithm must find the utterances to determine if they are in fact language. This places a burden on computational complexity of processors and is a resource drain on portable electronic devices. A speech detection approach having computational efficiency as well as accuracy is needed.

SUMMARY OF THE INVENTION

The inventors of the present invention have discovered that there is a high variance associated with voiced speech such as vowels and the low variance associated with silences and wide-band noise. Speech presence can be efficiently detected in a noisy environment by way of frequency and temporal considerations using this variance.

Speech presence is detected by first bandpass filtering the speech to split it into banks of sub-bands. A matrix of shift registers secondly store each sub-band of speech. A power determining circuit then determines individual power measurements of the speech stored in each shift register element. A combining circuit combines the individual power measurements to provide a variance for the individual shift registers. A comparator circuit finally compares the variance with at least one threshold to indicate whether speech is detected. The present invention can be implemented by software in a microprocessor, digital signal processor or combinations with discrete components.

The details of the preferred embodiments of the invention will be readily understood from the following detailed description when read in conjunction with the accompanying drawings wherein:

DETAILED DESCRIPTION OF THE PREFERRED EMBODIMENTS

Figure 1:
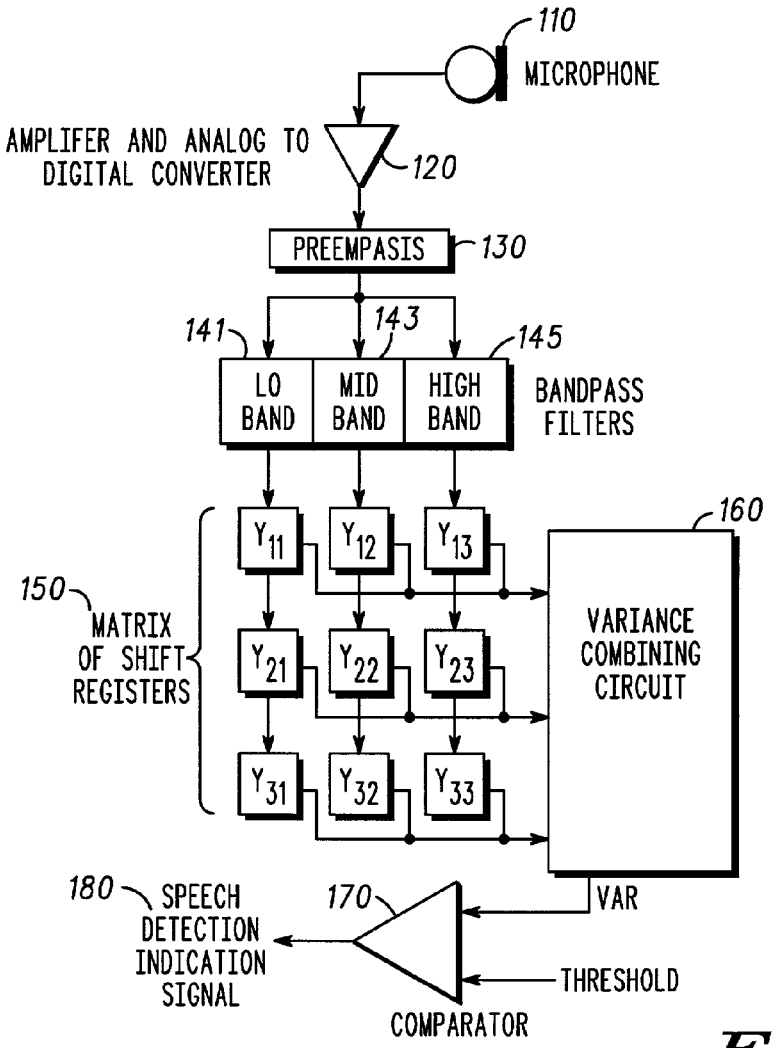
FIG. 1 illustrates a schematic block diagram of a time-frequency matrix and variance circuit for speech detection according to the present invention.

FIG. 1 illustrates a schematic block diagram of the time-frequency matrix and variance circuit for speech detection according to the present invention. A microphone 110 gathers speech often in a noisy environment. In amplifier and analog to digital converter 120 amplifies and conditions the electrical speech signal received by the microphone 110 and converts the electrical speech signal to digital speech sampled in time. In the preferred embodiment, the digital speech is sampled at preferably an 8 kHz sampling frequency and stored in frames preferably having a 10 millisecond duration. A preemphasis circuit 130 operates on the digital speech to equalize its power spectrum to make its frequency spectrum more flat. A digital signal processing emphasis of $1\text{-}0.9\ Z^{-1}$ is preferred to equalize the input signal and derive a preemphasized output signal.

Low band bandpass filter 141, mid band bandpass filter 143 and high band bandpass filter 145 split the preemphasized digital speech signal into a bank of preferably three sub-bands. Although a bank of three sub-bands is preferred, two or more sub-bands will work depending on the level of processing power and degree of detection accuracy needed for a noisy environment. It is preferred that the bandpass filters 141,143 and 145 divide the speech signal into somewhat equal sub-bands between 100 Hz and 3,000 Hz as follows. The low band bandpass filter 141 preferably has a band between 100 Hz and 1267 Hz, the mid and bandpass filter 143 preferably has a bandpass between 1267 Hz and 2433 Hz. The high band bandpass filter 145 preferably has a bandpass between 2433 Hz and 3600 Hz. Different band widths can be used for each sub-band.

A matrix of shift registers 150 receives the three sub-bands from the bandpass filters 141, 143 and 145. The shift registers 150 store each of the sub-bands and shifted to a next register location for each frame. In the preferred embodiment a total of three frames are stored in the shift registers, thus creating a three-by-three matrix $Y_{ij}$ consisting of matrix elements $Y_{11}$, $Y_{12}$, $Y_{13}$, $Y_{21}$, $Y_{22}$, $Y_{23}$, $Y_{31}$, $Y_{32}$ and $Y_{33}$. This matrix stores the speech information by way of both frequency and temporal considerations. Each of the three-by-three matrix elements contains sub-registers 250 for storing multiple samples k within a frame. For each of the register memories of the shift registers 150, a power measurement $X_{ij}$ is derived from the contents of the sub-registers. The calculation of the power measurements $X_{ij}$ for each sub-band over a frame i within a preferred 10 ms frame duration is performed by $$X_{ij} = \sum_k s_{ijk}^2 \tag{1}$$

wherein i is the frame index;

wherein j is a frequency sub-band index;

wherein k is the sample index within a frame; and wherein $S_{ijk}$ is the speech samples for a given frame index i, a given frequency sub-band j and a given sample index k.

The calculations of the power measurements $X_{ij}$ are preferably calculated within each of the matrix elements $Y_{ij}$ of the shift register 150. The power measurement calculation sums the squares of each of the power samples for a particular sub-band over time. More detail for the preferred calculation of the power measurement for a sub-band across a number of samples in the shift register elements will later be described with reference to FIG. 2 in more detail. Alternatively, a variance combining circuit 160 can be performed calculations of the power measurements.

The inventors of the present invention have discovered there is a high variance associated with voiced speech such as vowels and the low variance associated with silences and wide-band noise. A variance is a mathematical relationship known in digital speech processing as defined in elementary digital signal processing textbooks as such as *Digital Communications*, equations 1.1.65 or 1.1.66, by Proakis on page 17, published in 1989. The present invention applies a variance to a time-frequency power measurement to detect speech presence.

A variance combining circuit 160 calculates the variance of the plurality of power measurements for each sub-band and each frame. Calculating the variance VAR of the plurality of power measurements $X_{ij}$ for each sub-band j for each frame index i is calculated by $$\mathrm{VAR} = \frac{\sum X_{ij}^2}{n} - \left(\frac{\sum X_{ij}}{n}\right)^2 \tag{2}$$

wherein i is the frame index;

wherein j is a frequency sub-band index;

wherein $X_{ij}$ is the power for a given time sample index i and a given frequency sub-band j.

A comparator 170 compares the variance VAR with a threshold to determine whether or not the presence of speech is detected. When the variance is above the threshold, the presence of speech is detected, and a speech detection indication signal 180 is output. The threshold is preferably a fixed level however a variable threshold under certain conditions will yield more favorable results. A variable threshold can depend on determined by using an average of the past history of non-speech frames. Further, multiple thresholds can be implemented, one for clearly speech, one for clearly unspeech. A decision is made upon a transition over either of these thresholds.

The presence of speech indicated by the speech detection indication signal 180 can be used to gate on and off a speech recognition unit. The detection of the presence of speech is useful to gate and off a speech recognition unit so that the speech recognition unit does not need to operate continuously. This saves processing time that can be used for other purposes and/or conserves power, which reduces battery consumption in a portable electronic device. When a speech recognition circuit is present in a portable electronic device such as a cellular telephone, battery savings are achieved by freeing up the processor for other functions when speech presence is accurately determined. Also, the speech presence detection circuit does not require full activation of a recognition code so its more efficient. Reduction of miss-recognition is also achieved when using better speech presence accuracy. The speech detection indications are also useful for other devices such as speaker phones.

Figure 2:
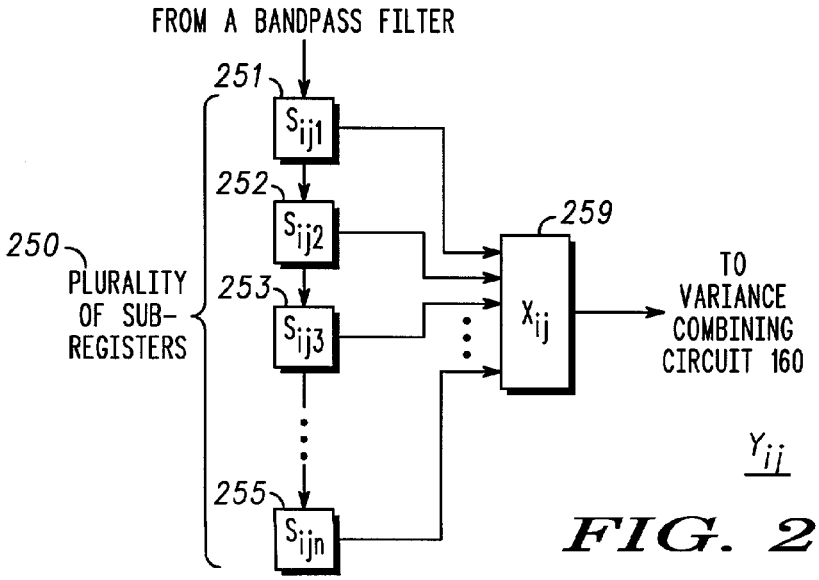
FIG. 2 illustrates a detailed schematic block diagram of one matrix element of FIG. 1 for determining power measurements used in the speech detection according to the present invention.

FIG. 2 illustrates a detailed schematic block diagram of the preferred construction of a plurality of sub-registers 250 and a power calculation circuit 259 for determining power measurements used in the speech detection according to the present invention. The preferred calculation of the power measurement for a sub-band, across a number of samples in one matrix element, is illustrated. The a plurality of sub-registers 250 and a power calculation circuit 259 are within one of the nine three-by-three matrix elements $Y_{ij}$ illustrated in FIG. 1. A plurality 250 of sub-register elements 251, 252, 253 through 255 receive the filtered sub-band speech from a bandpass filter of FIG. 1. Each sub-register element contains a speech sample $S_{ijk}$ for a given time and frequency sub-band. Sub-register element 251 corresponds to a first sample index k=1 within a frame for a given frame i and sub-band j. Sub-register element 252 corresponds to a second sample index and sub-register element 253 corresponds to a third sample index. A total of up to n sample indexes k are possible.

A power calculation circuit 259 calculates the average power among the sub-register elements for the given frame i and sub-band j. The average power $X_{ij}$ is calculated using the above equation (1). Each power calculation circuit 259 corresponds to one of the shift register elements in the matrix of FIG. 1. The output of the power calculation circuit 259 connects to the variance combining circuit 160 of FIG. 1.

Figure 3:
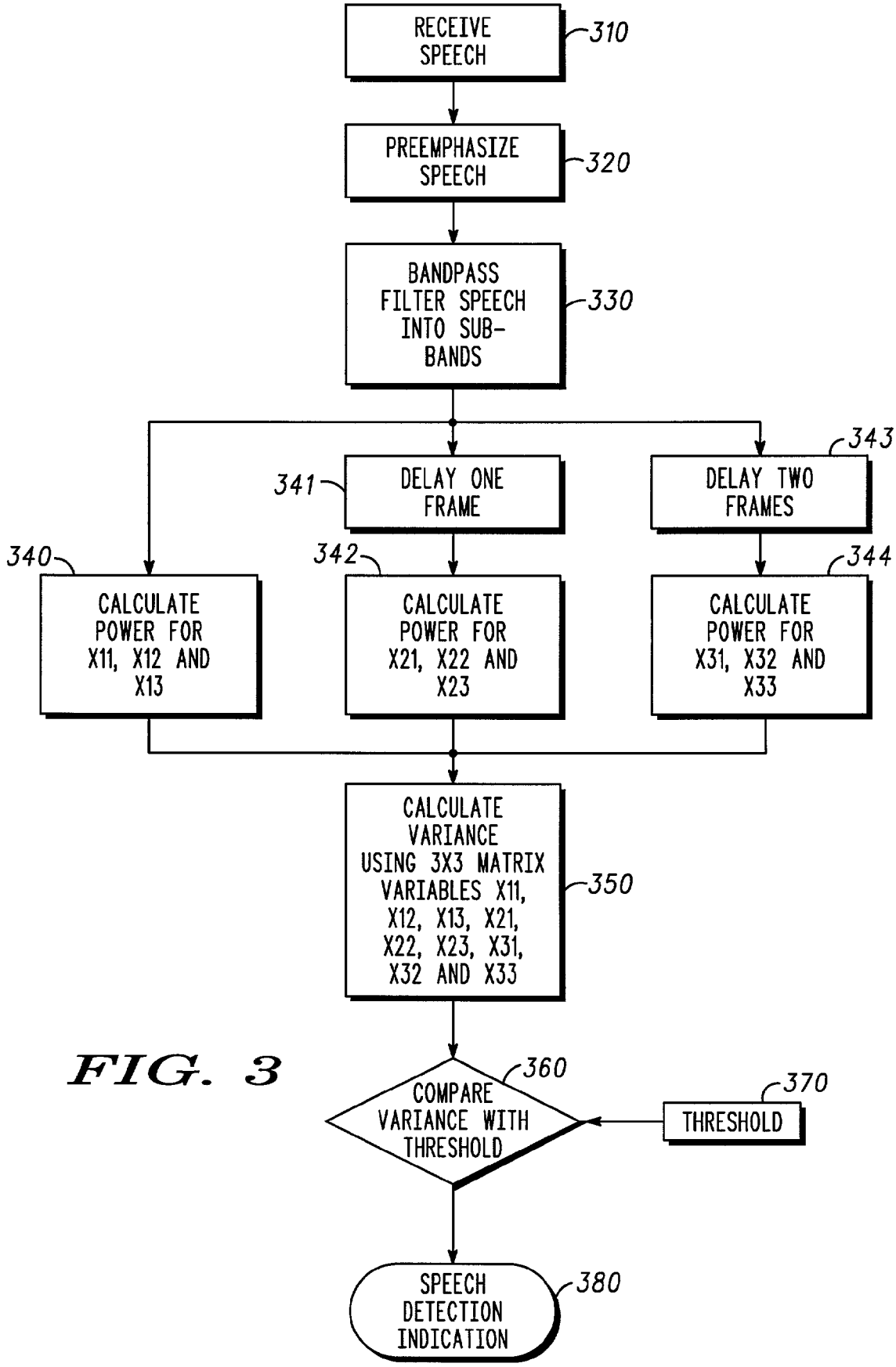
FIG. 3 illustrates a flow chart diagram for performing time-frequency matrix to detect speech according to the present invention.

FIG. 3 illustrates a flow chart diagram for performing time-frequency matrix to detect speech according to the present invention. In step 310, speech is received, often in a noisy environment. In step 320 the received speech is preemphasized to improve recognition accuracy by equalizing the power spectrum of the speech signal to flatten its frequency spectrum. In step 330 to the speech is bandpass filtered into sub-bands. A power calculation is made in step 340 for the various samples over the various sub-bands. A power calculation is made in step 342 over the samples for the various sub-bands after delaying one frame in step 341. A power calculation is made in step 344 over the samples for the various sub-bands after delaying to frames in step 343. In step 350, a variance is calculated using the power calculations derived above over frequency and over time. This variance is compared in step 360 with at least one threshold 370 to indicate that speech presence is detected at output 380 when the variance is above the threshold.

The signal processing techniques of the present invention disclosed herein with reference to the accompanying drawings are preferably implemented on one or more digital signal processors (DSPs) or other microprocessors. Nevertheless, such techniques could instead be implemented wholly or partially as discrete components. Further, it is appreciated by those of skill in the art that certain well known digital processing techniques are mathematically equivalent to one another and can be represented in different ways depending on the choice of implementation. For example the square of the terms in the variance calculation and/or power calculation can be substituted for absolute values without affecting the results.

Although the invention has been described and illustrated in the above description and drawings, it is understood that this description is by example only, and that numerous changes and modifications can be made by those skilled in the art without departing from the true spirit and scope of the invention. Although the examples in the drawings depict only example constructions and embodiments, alternate embodiments are available given the teachings of the present patent disclosure.

What is claimed is:

1. A speech presence detection apparatus, comprising:

a plurality of bandpass filters for splitting speech into a bank of sub-bands;

a plurality of shift registers each connected to and associated with one of the bandpass filters for storing the speech of a corresponding sub-band in register elements;

a power determining circuit for determining individual power measurements of the speech stored in each register element;

a variance combining circuit for combining the individual power measurements to provide a time-frequency variance for the individual registers; and a comparator circuit for comparing the variance with a threshold to indicate whether speech is detected.

2. A method of detecting the presence of speech, comprising the steps of:

(a) calculating a plurality of power samples of speech, each power sample corresponding to a frequency sub-band and time frame of the speech; and (b) calculating a time-frequency variance of the plurality of power samples; and (c) comparing the time-frequency variance with at least one threshold to indicate whether speech is detected.

3. A method according to claim 2, wherein the calculation in step (a) of the plurality of power samples of the speech over time and frequency comprises calculating a power corresponding to different audible bands and different sampling periods.

4. A method according to claim 2, wherein the calculation in step (a) of the plurality of power samples of the speech over time and frequency comprises the substeps of (a1) bandpass filtering the speech into banks of sub-bands; (a2) storing the speech of a corresponding sub-band; and (a3) calculating a power of the sub-band over a frame.

5. A method according to claim 2, wherein step (a) of calculating a plurality of power samples of speech comprises $$X_{ij} = \sum_k s_{ijk}^2$$

wherein i is the frame index;

wherein j is a frequency sub-band index;

wherein k is the sample index within a frame; and wherein $S_{ijk}$ is the speech samples for a given frame index i, a given frequency sub-band j and a given sample index k.

6. A method according to claim 2, wherein step (b) of calculating a time-frequency variance of the plurality of power measurements comprises $$\mathrm{VAR} = \frac{\sum X_{ij}^2}{n} - \left(\frac{\sum X_{ij}}{n}\right)^2$$

wherein i is a frame index;

wherein j is a frequency sub-band index;

wherein $X_{ij}$ is the power measurement for a given time sample index i and a given frequency sub-band j.

7. A method according to claim 6, wherein the step (a) of calculating each power measurement comprises $$X_{ij} = \sum_k s_{ijk}^2$$

wherein i is the frame index;

wherein j is a frequency sub-band index;

wherein k is a sample index within a frame; and wherein $S_{ijk}$ is the speech samples for a given frame index i, a given frequency sub-band j and a given sample index k.

8. A method according to claim 2, wherein the calculation in step (c) of comparing the time-frequency variance with at least one threshold indicates that speech is detected when the time-frequency variance is above a threshold.

9. An apparatus for detecting the presence of speech, comprising:

means for calculating a plurality of power samples of speech, each power sample corresponding to a frequency sub-band and time frame of the speech;

means for calculating a time-frequency variance of the plurality of power samples; and means for comparing the time-frequency variance with at least one threshold to indicate whether speech is detected.

10. An apparatus according to claim 9, wherein the means for calculating a time-frequency variance of the plurality of power samples comprises $$\mathrm{VAR} = \frac{\sum X_{ij}^2}{n} - \left(\frac{\sum X_{ij}}{n}\right)^2$$

wherein i is a frame index;

wherein j is a frequency sub-band index;

wherein $X_{ij}$ is the power for a given time sample index i and a given frequency sub-band j.

* * * * *